United States Patent [19]

Carl

[11] Patent Number: 4,931,701

[45] Date of Patent: Jun. 5, 1990

[54] BI-LEVEL BALLAST CIRCUIT FOR OPERATING HID LAMPS

[75] Inventor: Michael J. Carl, New Braunfels, Tex.

[73] Assignee: Wide-Lite International Corporation, San Marcos, Tex.

[21] Appl. No.: 215,605

[22] Filed: Jul. 6, 1988

[51] Int. Cl.[5] ..... H05B 41/42

[52] U.S. Cl. ..... 315/240; 315/239; 315/291; 315/DIG. 4

[58] Field of Search ..... 315/186, 187, 209 R, 315/226, 227 R, 231, 240, 254, DIG. 4, 244, 239, 291, 311, 173

[56] References Cited

U.S. PATENT DOCUMENTS

| | | | |
|---|---|---|---|
| 3,662,216 | 5/1972 | Hildebrant | 315/205 |
| 3,679,932 | 7/1972 | Murphy | 315/106 |
| 4,135,115 | 1/1979 | Abernethy et al. | 315/97 |
| 4,291,254 | 9/1981 | Arlt et al. | 316/240 |
| 4,447,764 | 5/1984 | Kornrumpt et al. | 315/240 |
| 4,447,765 | 5/1984 | Cote et al. | 315/240 |
| 4,482,844 | 11/1984 | Schweer et al. | 315/194 |
| 4,516,056 | 5/1985 | Cote et al. | 315/240 |
| 4,525,651 | 6/1985 | Ahlgren | 315/240 |
| 4,559,479 | 12/1985 | Munson | 315/239 |
| 4,808,886 | 2/1989 | Latham et al. | 315/227 R |

*Primary Examiner*—Eugene R. LaRoche

*Attorney, Agent, or Firm*—Vaden, Eickenroht, Thompson & Boulware

[57] ABSTRACT

A bi-level ballast network is disclosed for operating an HID lamp at either a low power or standby level and at a high power or full light level. The network includes an unswitched capacitor connected to the transformer ballast coil and a switched capacitor connected to a solid state relay (SSR) circuit, the electronic components providing the switching therein being back-to-back SCR's. When the SSR is operated the contacts connected to the switched capacitor open or close at the next subsequent zero crossing of the applied ac source voltage. This changes the capacitance of the network to increase the power to the lamp or decrease the power thereto depending on the operating condition prior to the SSR being operated. Current, voltage and dvdt protection devices are also provided.

8 Claims, 2 Drawing Sheets

BI-LEVEL BALLAST CIRCUIT FOR OPERATING HID LAMPS

BACKGROUND OF THE INVENTION

1. Field of the Invention

This invention pertains to a ballast circuit for operating an HID lamp and more specifically to such a ballast circuit capable of operating either in a reduced energy standby mode or a full light output mode.

2. Description of the Prior Art

High intensity discharge (HID) lamps include mercury vapor lamps, metal halide lamps, and high pressure sodium lamps, each requiring a ballast circuit operating therewith to accommodate to the pre-strike and post-strike conditions of the lamp. Conventionally magnetic transformer ballasts have been employed to provide the voltage and current compensation required. Even the most sophisticated circuits, however, cannot instantaneously cause such a lamp to go from a cold start to a high level operation and, therefore, unlike incandescent lamps or even fairly rapidly starting low pressure discharge lamps, for example, fluorescent lamps, if the operating requirements are such as to make desirable a fast full light output condition, it is required to keep such lamps operating at a dimming output level to begin with. Moreover, a dimming condition is often desirable in any event to provide emergency lighting to the areas serviced by the lamps.

Dimming controls suitable for non-HID lamps are notoriously unsuited for HID lamps that must have a continuous voltage and current condition maintained and without prolonged phase reversals, characteristic of many of such devices, since this will cause HID lamps to extinguish. Extinguishment of an HID lamp requires a subsequent long start up time, as discussed above. Many other techniques employed are not efficient in that although providing reduced power to the lamp, there is no reduction of power overall, excess power not directed to the lamp being wasted in heat loss or the like. Nevertheless, various techniques have been employed to provide dimming, perhaps the most successful being the employment of careful removal of some of the applied voltage to a lamp each half cycle without causing lamp extinguishment. A circuit that does this is shown in U.S. Pat. No. 4,482,844, Schweer, et al., commonly assigned.

However, a range of dimming operations such as shown in the '844-type circuits is usually not required, such circuit having a large number of components to accomplish this feat. It is usually satisfactory for a ballast circuit to operate either at a full light output level or at a reduced output light level. Moreover, although all or nearly-all electronic ballasts have been designed and made available in recent years, it is still recognized that constant wattage auto-transformer (CWA) ballasts and regulated lag ballasts are still highly favored for their dependable operation. Heretofore, a relatively simple and efficient bi-level ballast circuit operating with a conventional magnetic transformer ballast has not been available.

Therefore, it is a feature of the present invention to provide an improved bi-level operating ballast circuit for operating with a magnetic transformer ballast to efficiently operate an HID lamp at a reduced energy, standby mode and alternatively to operate such lamp at a high, full light level mode.

It is another feature of the present invention to provide an improved bi-level ballast circuit HID operation including controlled switching that occurs at zero voltage crossings, thereby minimizing disruptive, often harmful results.

SUMMARY OF THE INVENTION

Circuits are shown for preferred connections to several different types of HID lamps. In each case, however, the circuit includes a conventional magnetic transformer connected to an unswitched capacitor, which, in turn, is connected to the lamp (or lamp circuit) for operation at a first level. A switched capacitor connected to a control switching means, preferably incorporating a solid state relay (SSR) having back-to-back SCR's, is controllably switched into combination with the unswitched capacitor to provide a second level of power operation for the lamp. The switch-in (or switch-out) occurrences are automatically timed to occur at a zero crossing point of the applied source voltage and, therefore, applies or removes the switched capacitor only when the voltage level is not able to cause excessive spiking or surging by the switched capacitor being partly or fully charged.

BRIEF DESCRIPTION OF THE DRAWINGS

So that the manner in which the above-recited features, advantages and objects of the invention, as well as others which will become apparent, are attained and can be understood in detail, more particularly description of the invention briefly summarized above may be had by reference to the embodiments thereof that are illustrated in the drawings, which drawings form a part of the specification. It is to be noted, however, that the appended drawings illustrate only preferred embodiments of the invention and are, therefore, not to be considered limiting of its scope for the invention may admit to other equally effective embodiments.

In the drawings.

DESCRIPTION OF THE PREFERRED EMBODIMENTS

Figure 1:
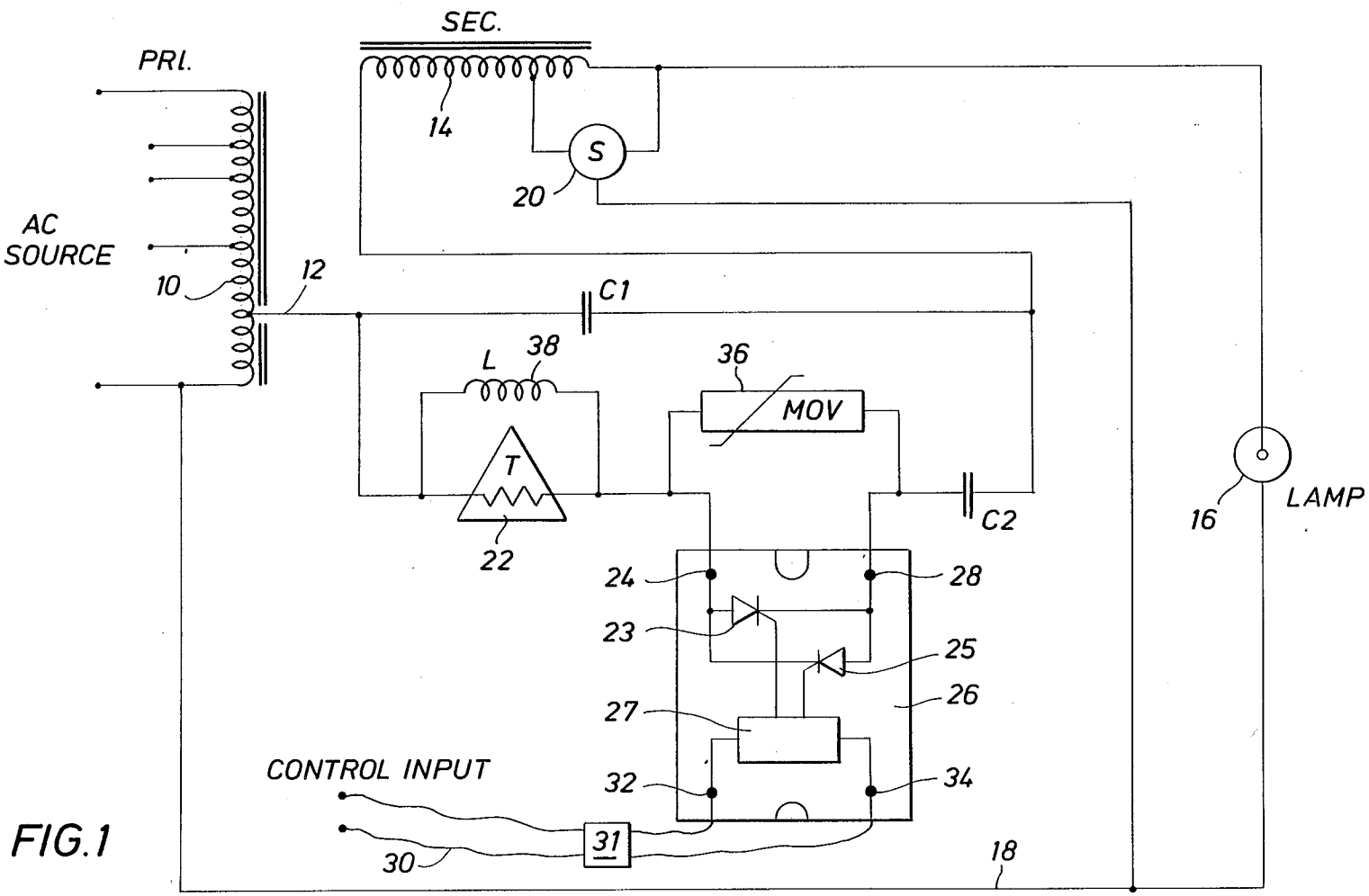
FIG. 1 is a simplified schematic diagram of a bi-level ballast circuit in accordance with a preferred embodiment of this invention suitable for operating a 150, 250, or 400 watt, high pressure sodium vapor lamp.

Now referring to the drawings and first to FIG. 1, a simplified schematic diagram of a first preferred embodiment is shown. A step-up magnetic transformer ballast, normally a constant wattage auto-transformer, has a primary coil 10 connected to an ac source, nominally at 110–120 volts, 60 hertz. A tap 12 therefrom is connected to unswitched capacitor C1, which, in turn, is connected in series with secondary coil 14 of the transformer ballast. The secondary coil is connected to a lamp 16, the return connection to the lamp being to common line 18, which is also connected to primary coil 10. Lamp 16 in this embodiment can be a 150, 250, or 400 watt, high pressure sodium vapor lamp. A starter device 20 is connected across a portion of secondary coil 14 and across lamp 16, in conventional fashion, the tapped portion of the coil providing operating voltage differential for the starter device.

Also connected to tap 12 is a connection to thermistor 22, which, in turn, is connected to a first terminal 24 of a solid state relay (SSR) 26. The second terminal of SSR 26 is connected to switched capacitor C2, which, in turn, is connected to the junction of C1 and secondary coil 14 of the circuit to lamp 16.

Solid state relay 26 includes back-to-back SCR's 23 and 25 across terminals 24 and 28 and a control input 30 to input terminals 32 and 34, input 30 leading to a manual control switch 31 to connect the control input to a voltage source, either ac or dc, to cause relay firing circuit 27, included within SSR 26, to gate on or off SCR's 23 and 25.

Finally, a metal oxide varistor 36 is connected across terminals 24 and 28 of SSR 26 and, in a heavy duty version of the circuit, a choke coil 38 is connected across thermistor 22.

Operation of control input 30 to SSR 26 results in the effective closing or opening of the electronic switch in the form of back-to-back SCR's 23 and 25 connected as part of the internal network of the SSR from terminal 24 to 28. However, the switch does not operate instantaneously with the operation of the control switch. The voltage level of the AC source applied to coil 10 must pass through zero either in its descending progression or its ascending progression for the switching to occur. When the SSR is operated "closed", a full-wave rectified voltage results, each SCR operating in an alternate half-wave rectifying mode. When the SSR is operated "open", the SCR's are both held in their open conditions. As will be explained below, the switching timing is important to the operation of the overall circuit.

Now turning to operation of the illustrated circuit, it is first assumed that the internal switch of SSR 26 just described connected between terminals 24 and 28 is closed, thereby effectively putting C1 and C2 in parallel (except for protection devices 22, 36 and 38). Hence, the capacitance of the parallel combination is at a value higher than the capacitance value of either capacitor alone, and specifically at a value higher than that of capacitor C1. Together with the primary and secondary coils, this parallel capacitance combination enables a higher current to be supplied to lamp 16, thereby causing it to operate at a normal energy consumption level or in its full light mode.

Removal of the control input to SSR 26 causes the switch across terminals 24 and 28 at the next zero crossing of the applied voltage to remove capacitor C2 from the circuit. Thus, capacitor C1, together with the primary and secondary ballast coils, but without capacitor C2, now supply lamp 16 with a substantially lower level current to produce reduced light output from lamp 16. The lamp operates in this mode until the control input to SSR 26 is again operated to put the conditions back into the full energy consumption mode once again. Again, switching occurs not instantaneously with operation of the manual control, but at the next zero crossing occurrence of the applied ac source voltage or the voltage applied to the primary coil of the ballast.

Operation in this manner prevents capacitor C2 from being switched in or out of the circuit while partly or fully charged and therefore prevents spikes or surges from being applied to lamp 16 and other ballast components.

Thermistor 22 resides in series with the SSR to protect it from current surges appearing on the line. Metal oxide varistor 36 resides in parallel with the SSR to protect it from voltage surges. Choke 38 protects the SSR for dvdt, or half-cycle switching, correction.

Figure 2:
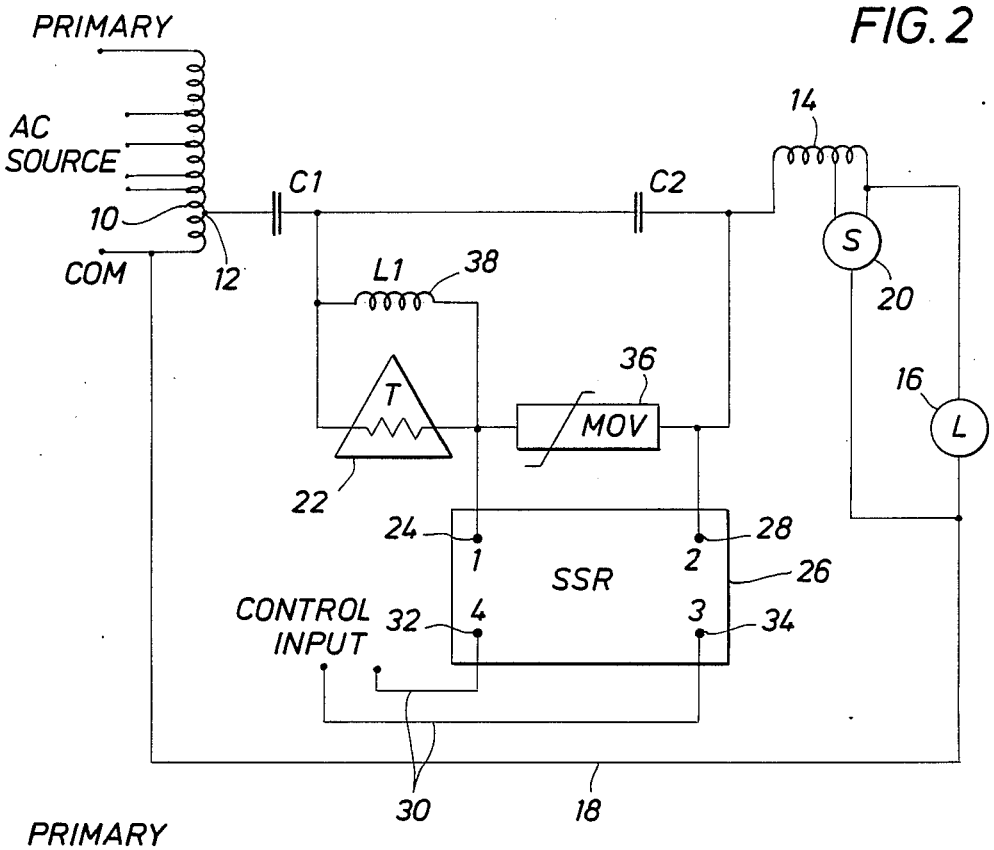
FIG. 2 is a simplified schematic diagram of a bi-level ballast circuit in accordance with a preferred embodiment of this invention suitable for operating a 1000 watt high pressure sodium vapor lamp.

Now referring to FIG. 2, a preferred embodiment of the circuit connections for operating a 1000 watt high pressure sodium lamp is shown. Like parts in common with FIG. 1 are shown with the same numbers for convenience.

However, the bi-level switching components of the circuit are connected differently from FIG. 1. Capacitor C2 is in series with C1, instead of parallel. The connection of thermistor 22 is connected to a junction point between capacitors C1 and C2 and terminal 28 of SSR 26 is connected to the junction between capacitor C2 and coil 14. Thus, except for the protection devices, the electronic switch terminals of the SSR are in parallel with capacitor C2.

In operation in the reduced energy consumption mode of this circuit, the electronic switch is operated open to effectively place capacitor C2 in operation. Thus, the coils and capacitor C1 alone determine the operating current applied to lamp 16. In this case, capacitor C1 is sized to provide the full energy consumption current operation. When terminals 24 and 28 are effectively switched open at a zero crossing of the applied ac source voltage, as described above, then capacitor C2 is put in series with capacitor C1, thereby reducing the total capacitance to that required to provide the standby or reduced energy consumption mode.

Thermistor 22, varistor 36, and choke 38 provide the protections described above. When switched capacitor C2 is in series with unswitched capacitor C1, as is the case with the FIG. 2 circuit, choke 38 is in series with the SSR to provide dvdt correction.

Figure 3:
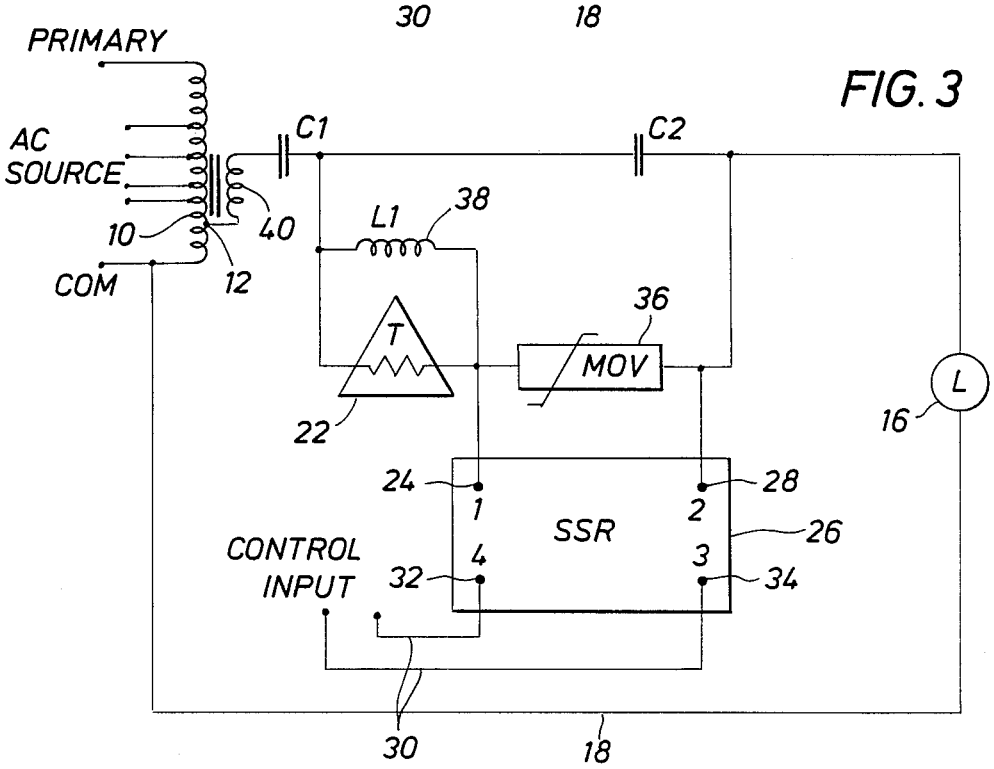
FIG. 3 is a simplified schematic diagram of a bi-level ballast circuit in accordance with a preferred embodiment of this invention suitable for operating a 175–1000 watt metal halide or mercury vapor lamp.

FIG. 3 is a circuit showing the inventive bi-level ballast network connected in a preferred manner for operating a 175–1000 watt metal halide or mercury vapor lamp. The differences between the FIG. 2 and FIG. 3 circuits pertain to the absence of coil 14 and starter device 20 from the FIG. 3 circuit and the addition of coil 40. Coil 40 precedes capacitor C1. This coil provides voltage step-up for required operation (instead of coil 14 shown in FIGS. 1 and 2). Otherwise the two are the same. With respect to the inventive network components, there are no differences.

While several preferred embodiments of the invention have been shown, it will be understood that the invention is not limited thereto. Many modifications may be made, which will become apparent to those skilled in the art. For example, the operating control connected to SSR 26 has been characterized as a manual control. Alternatively, it can readily be automated, such as by a time clock or other device, if desired. In addition, HID lamp wattages other than those specifically described may be operated in an energy saving mode employing the techniques herein described.

What is claimed is:

1. A bi-level ballast circuit for operation an HID lamp alternatively in a reduced energy standby mode and a full light output mode, comprising a magnetic transformer ballast having an input connection to an ac power source, an unswitched capacitor connected in series with the output of said transformer ballast and with the lamp to ensure at least a reduced power level applied to the lamp, a switched capacitor connected to said unswitched capacitor and the lamp, a control power source, and control switching means connected to said switched capacitor and connectable to said control power source for increasing the total capacitance and thereby the total power applied to the lamp to operate the lamp at a full light output level, said switching means including closing and opening contacts to said switched capacitor that operate only at the time the voltage level of the applied ac power source passes through zero.

2. The bi-level ballast circuit of claim 1, wherein said switched capacitor is connected in series with said unswitched capacitor and said closing and opening contacts of said switching means are connected in parallel with said switched capacitor, said contacts being operated closed for increasing the total capacitance to the lamp.

3. The bi-level ballast circuit of claim 1, wherein said switched capacitor is connected in parallel with said unswitched capacitor and said closing and opening contacts of said switching means are connected in series with said switched capacitor, said contacts being operated closed for increasing the total capacitance to the lamp.

4. The bi-level ballast circuit of claim 1, wherein said control switching means includes two back-to-back SCR's in a solid state relay device.

5. The bi-level ballast circuit of claim 1, wherein said control switching means includes switch contacts connected to said switched capacitor and a thermistor in series with said contacts for current surge protection.

6. The bi-level ballast circuit of claim 1, wherein said control switching means includes switch contacts connected to said switched capacitor and a varistor in parallel with said contacts for voltage surge protection.

7. The bi-level ballast circuit of claim 1, wherein said control switching means includes switch contacts connected to said switched capacitor and a choke in series with said contacts for dvdt correction.

8. The bi-level ballast circuit of claim 1, wherein said control power source includes a manual control switch.

* * * * *